US011282134B1

(12) United States Patent
Lewison

(10) Patent No.: US 11,282,134 B1
(45) Date of Patent: Mar. 22, 2022

(54) SYSTEM AND METHOD FOR ONLINE VEHICLE AUCTIONS AND AUCTIONS OR OTHER PRICE DETERMINING EVENTS FOR OTHER GOODS AND SERVICES

(71) Applicant: Michael Lewison, Fresno, CA (US)

(72) Inventor: Michael Lewison, Fresno, CA (US)

(73) Assignee: KASSELRRL IP LLC, Deerfield Beach, FL (US)

( * ) Notice: Subject to any disclaimer, the term of this patent is extended or adjusted under 35 U.S.C. 154(b) by 0 days.

(21) Appl. No.: 16/589,949

(22) Filed: Oct. 1, 2019

Related U.S. Application Data

(60) Provisional application No. 62/750,586, filed on Oct. 25, 2018.

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC ..... G06Q 30/08
See application file for complete search history.

(56) References Cited

U.S. PATENT DOCUMENTS 7,461,022 B1 * 12/2008 Churchill ..... G06Q 10/02 705/26.3
2004/0128224 A1 * 7/2004 Dabney ..... G06Q 30/08 705/37
2004/0133479 A1 * 7/2004 Grove ..... G06Q 40/00 705/26.3
2015/0025993 A1 * 1/2015 Kiglies ..... G06F 3/048 705/26.3
2020/0134758 A1 * 4/2020 Gabel ..... G06Q 30/08

OTHER PUBLICATIONS

Sonavale, Sandeep S., and B. R. Londhe. "Factors Influencing the Success of Electronic Reverse Auctions in Public Procurement in India." Journal Homepage: http://ijmr. net. in 7.05 (2019).*

* cited by examiner

*Primary Examiner* — Kathleen Palavecino
(74) *Attorney, Agent, or Firm* — Crowe & Dunlevy; Jeremy B. Berman

(57) ABSTRACT

A system and method are disclosed for auctioning vehicles or other products and services where bids or offers for items offered for sale are evaluated against auction conditions. A method for auctioning one or multiple products or services where during the course of the auction the value of a bid amount required to win is reduced based upon auction conditions. A method is disclosed for displaying, evaluating and accepting bids or offers to purchase in the form of multiple payments over time that are equivalent in value to a singular valued price during an auction. The methods can be implemented via a programmed module operating on a computing system as a special purpose computer.

8 Claims, 4 Drawing Sheets

SYSTEM AND METHOD FOR ONLINE VEHICLE AUCTIONS AND AUCTIONS OR OTHER PRICE DETERMINING EVENTS FOR OTHER GOODS AND SERVICES

PRIORITY CLAIM

The present application claims the benefit of U.S. Provisional Patent Application Ser. No. 62/750,586, filed Oct. 25, 2018, titled "Systems and Methods for Online Vehicle Auctions," the contents of which are hereby incorporated by reference as if set fully herein.

FIELD OF THE INVENTION

The present disclosure relates generally to online auctions and more particularly to online auctions having multiple bidding options. The present also relates to online events used to match a seller and a buyer with an agreeable price that is different than a price first shown.

BACKGROUND

When consumers are in the market for purchasing a new or used vehicle, a major concern is that the purchase price is too high or that their negotiated purchase price could have been better or lower or their purchase could have been structured more advantageously. The feeling of buyer's remorse is commonplace post purchase when buying a vehicle from an auto dealer because buyers never know if they paid a fair price. Vehicle auctions are one avenue for consumers to purchase a vehicle without the need to enter into a direct face to face price negotiation and retain a sense of control and transparency in the vehicle buying process. A consumer must be savvy in order to bid smartly and would like to have flexibility and choice in the way they place bids. The current auctioning systems do not address these problems and often enhance these issues with respect to the buyer's experience.

Further, buyers considering the purchase of expensive durable goods such as vehicles that operate on or in land, water or air, or expensive collectibles such as jewelry or artwork and other similar items, are often unable to consider a purchase through an auction, because the total cost is too financially prohibitive to settle at the end of an auction. Buyers of these types of products during typical, non-auction scenarios very regularly make use of lender financing to facilitate final transactions. The lack of opportunity to display and reconcile auction results based upon the costs of regular financing payments that the buyer can pay to acquire the product(s) or services, leaves buyers disinterested in many opportunities and sellers unable to complete potential transactions.

On the other side, a vehicle dealership must manage vehicle inventory carefully in order to control costs and maximize profit. If, for example, a new or used car sits on a dealer lot for months prior to purchase, costs of capital, costs of lost opportunity, insurance costs and maintenance costs may force the dealership to reduce the sales price of the new or used car to a breakeven level or even to a level that causes the dealership to incur a loss. In order to reduce inventory, dealerships may sell vehicles at auction in order to realize profit or move inventory that is no longer profitable. The structures of existing auctioning systems are not configured to handle these deficiencies in the auction process.

SUMMARY OF THE INVENTION

What is desired is an online auction system for vehicles and other products or services that provides incentives to entice consumers to utilize the auction site at a benefit to both consumer and dealership. Further desired would be for this system to have the capability of adjusting pricing for or negotiating pricing with the buyer on behalf of the seller. Even greater benefit would be delivered by the system that would be able to adjust pricing and/or offer discounting to the buyer incrementally which would benefit the seller by only offering enough adjustment or discounting to entice the buyer into a transaction. This system would also benefit by the ability to enable the buyer and seller to view the costs of and complete any transaction with a mutual understanding of how the payment of a total price can be replaced by the payment of multiple scheduled payments by the buyer. This system would have to reconcile the different value of various payment offerings by multiple bidders or offerors so that the offer with the optimum value for the seller can be accepted. Thus, a new special purpose system is introduced to perform new functions in an auctioning process to address the technical weaknesses of prior action-related systems.

DETAILED DESCRIPTION

The proposed technical improvements described herein address the weaknesses of prior auction systems. A focus of this new special purpose computer is that the bid by payment is not to model a financial application. The systems disclosed herein are seeking to match the way buyers typically purchase items. For example, by how much they can afford to pay each month, but within the concept of an auction. This new approach addresses issues with respect to why eBay motor and many other auction approaches never really work. Further, the approach disclosed herein to not constitute simply applying preexisting business processes via a generic processor. In other words, the concepts are not well known or fundamental economic practices long prevalent in our system of commerce.

Regarding the bid cost reduction system, this discloser addresses two problems with prior auction systems. First, the system provides an interesting experience for viewers where something would happen to the price even if potential buyers wouldn't take action and just watched the process. Second, the special purpose computer herein can model the concepts of a dealer reducing price like in a negotiation and put that into a multiple bidder auction type concept. Again, these are not fundamental economic practices long prevalent in our system of commerce.

Figure 1:
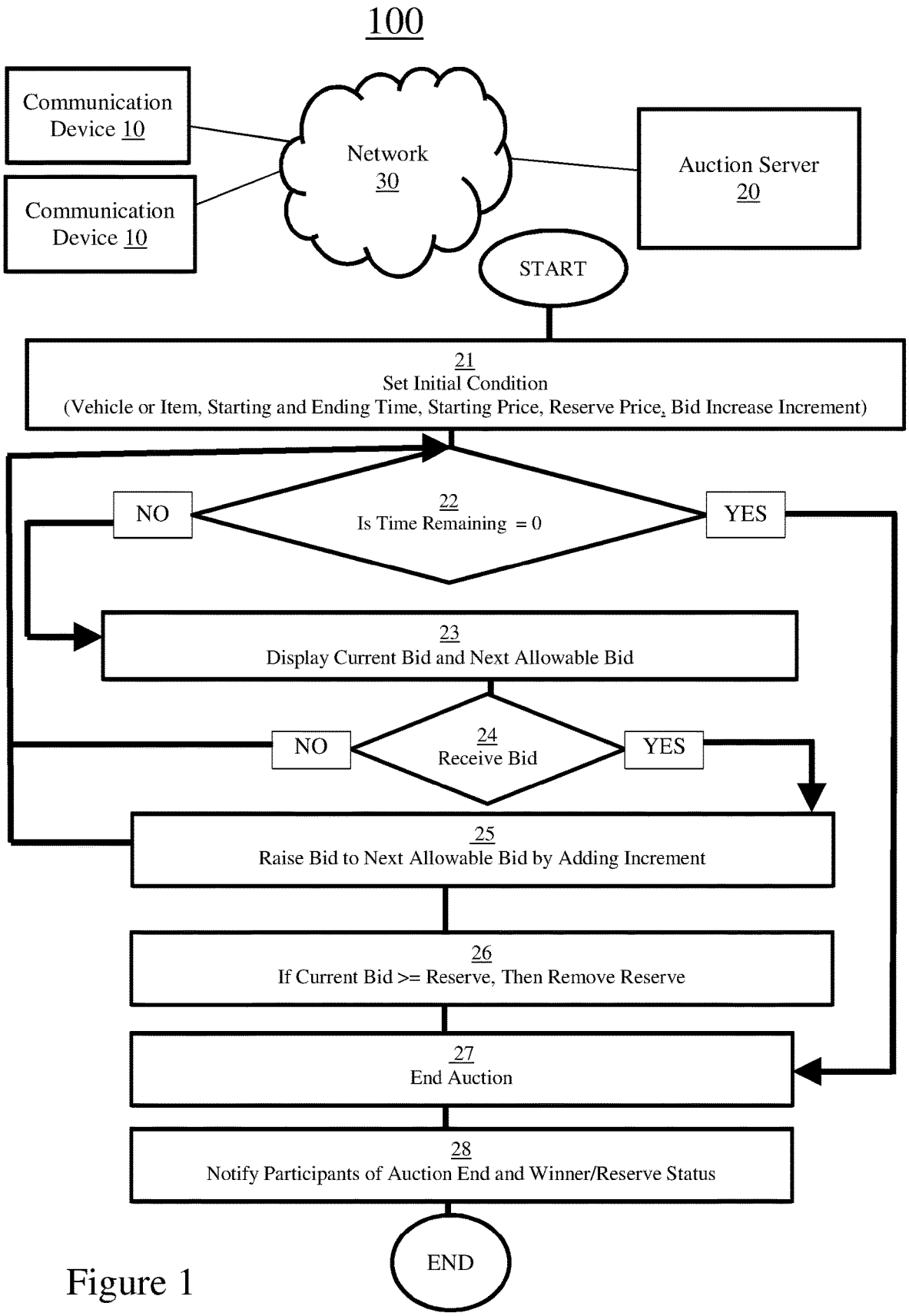
FIG. 1 shows a diagram of an exemplary environment for an online auction.

Referring to FIG. 1, a diagram of an exemplary environment for an online auction system 100 is shown. One or more communication devices, such as the communication device 10, communicate with an auction server 20 in an exemplary embodiment via a network 30. The communication device 10 may comprise a computing device, a personal digital assistant, a cellular or other smart telephone, a laptop, or the like. The network 30 may comprise any type of network, and may support any type of data communication via any standard or technology (e.g., GSM, CDMS, TDMA, WCDMA, LTE, EDGE, OFDM, GPRS, EV-DO, UWB, Internet, IEEE 802 including Ethernet, WiMAX, Wi-Fi, Bluetooth, and others). The network 30 may also be one or more private or local networks or dedicated frequency bands.

The auction server 20 may comprise any digital device, such as a server computer, a network of computers, or the like. According to an exemplary embodiment, the auction server 20 provides various network events to the communication devices 10 to enable the system of online auctions. The system or devices disclosed herein can include a processor (such as a central processor or graphics processor for operation in a computing system), memory (such as RAM, ROM, a hard drive, flash memory, or any other type of tangible memory), a bus, an input/output device, computer programming modules which operate to run particular code on the system and to turn the general processor into a special-purpose computer system. The memory can include a non-transitory computer-readable medium or device. For example a particular module can be a module programmed to cause a computer processor, in connection with managing a user interface, to receive one or more bids, evaluate the one or more bids against the initial auction conditions and each other to yield an evaluation and determine, based on the evaluation, an outcome of the auction, the outcome comprising identifying a winner when that participant's bid meets the initial action conditions for a winning bid, and identify any other non-winning participants. The module is created through computer programming and when the module is operable on the computing device, the device becomes a special purpose computer performing the algorithm(s) disclosed herein. Any function or functions described herein can be combined and implemented within a program module on a computing device as a special purpose computer.

The auction server 20 incorporates the services needed to run the auction. The auction is set up with starting price and an optional reserve price, as well as the amount or increment the displayed price or next bid will be raised following each placed bid, in addition to starting time and ending time at Step 21. Step 22 checks to see if there is time remaining in the auction. If yes, at Step 23 the system displays both the current highest bid and the next allowable bid calculated by adding the increment to the current highest bid. If there is no time remaining in the auction at Step 22, the system moves to Step 26 and ends the auction. At Step 24 the system waits for a new bid. If no bid is submitted, the system returns to Step 22. If a bid is placed, the current high bid is raised, and the next allowable bid is re-calculated at Step 25. At Step 26, the current high bid is compared to the reserve, if no, the system returns to Step 22. If the current high bid matches or exceeds the reserve at Step 26, the system removes the reserve and may or may not display this condition. At Step 27, the auction is over and the system checks whether the reserve has been removed at Step 26. At Step 28 all participants are notified of the auction's ending, their position in the final bidding results, if any, and the final condition of the reserve.

Figure 2:
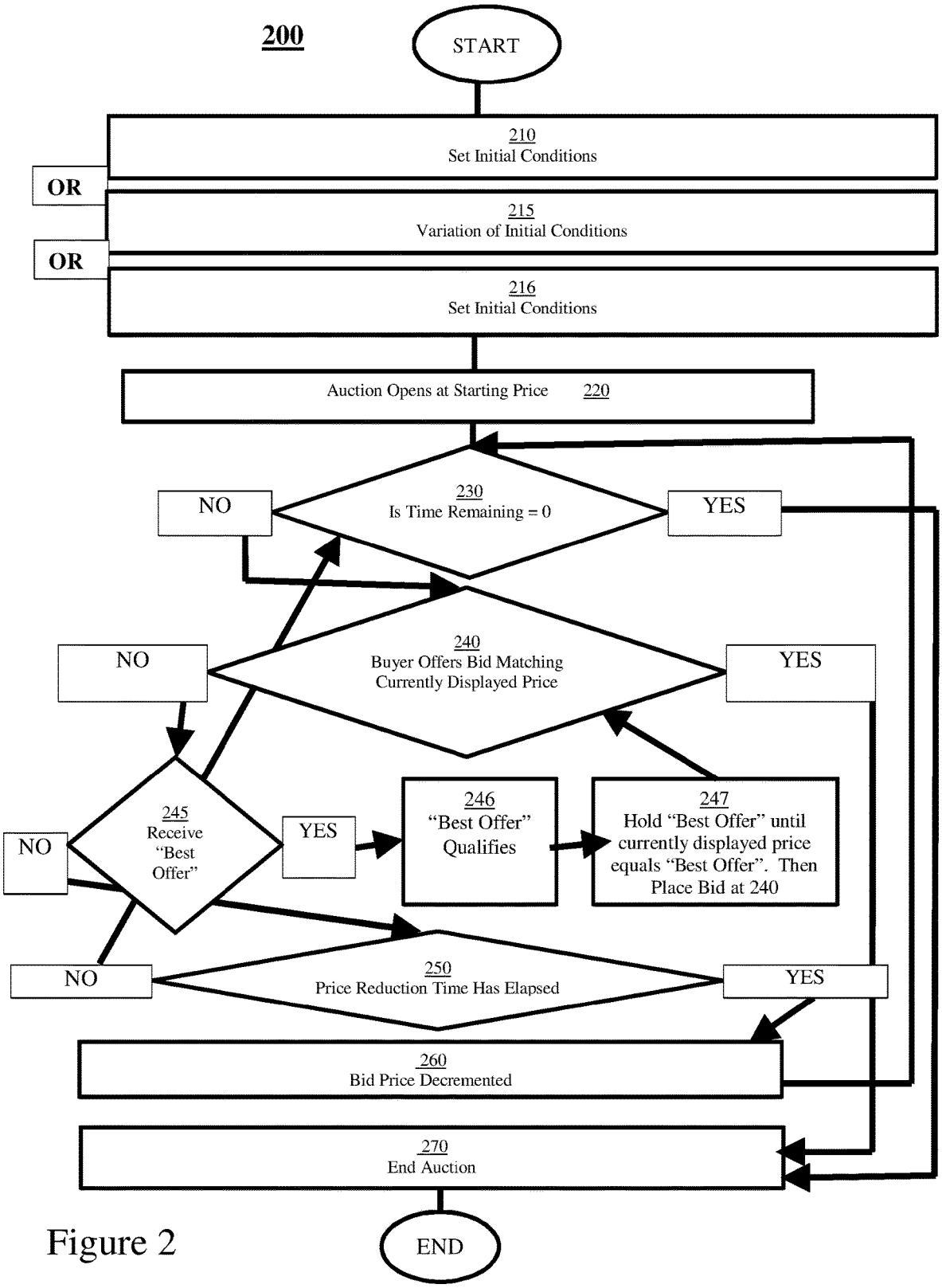
FIG. 2 shows a flow diagram of an exemplary auction system with a Bid Price Reduction or Increasing Incentive implementation system.

FIG. 2 shows a flow diagram of an exemplary auction system 200 with a Bid Price Reduction or Increasing Incentive implementation system. At step 210, the initial conditions for the auction system 200 are set by an administrator or are otherwise present by default. For example, the vehicle or unit is selected, the starting time of the auction is set. Also, a starting price for the auction and a reserve or ending price is set. The reserve is used by the system to establish the ending time by calculating at what time during the operation of the system, the currently displayed bid price has been reduced enough to equal the reserve. The reserve is never displayed to the participants. Also, the amount of time that will expire on the system clock prior to the next reduction of the bid price or Bid Time Increment is set. These are all set at Step 210. In this scenario, the system will calculate the size of each bid price reduction by determining the number of price reductions at the preset times that will be needed to reduce the start price enough to equal the reserve or ending price which will occur at the ending time, and then dividing the difference between the stating price and reserve by that value. An alternate exemplary variation of Step 210 is represented by Step 215. In Step 215 the initial conditions may be set as the starting price for the auction and the amount of reduction to take place over the course of the auction, which may also be represented as a pool of incentive money that can be drawn from to reduce, over the time of the auction, the total price shown to the buyer. In another alternate exemplary variation, represented by Step 216, the system can also be set to use a fixed value for the bid price reduction, i.e. $100. In this case, the system will determine the ending time of the auction by calculating the number of fixed value price reductions need to move the price downward from the starting price to the ending price or reserve and then multiply this by the preset amount of time that will expire on the system clock prior to the next reduction of the bid price. The resulting product is added to the starting time to determine the ending time of the auction.

Once the auction begins, the auction opens at the starting price at Step 220. Next, the auction system 200 Checks to see if the ending time has been reached at Step 230, and if the ending time has been reached, the auction ends at Step 270. If the ending time has not been reached, the system waits for any buyer to offer a bid by selecting the bid price currently displayed by the system at Step 240. If such an offer of a bid is made, the auction is complete at Step 270.

In operation, auction system 200 may allow for each bidder to place a "best offer" that is of lesser value than the bid price currently displayed and wait for the auction system 200 to reduce the bid price to match that input "best offer", Step 245. Once a "best offer" is received, Step 246 checks to see if the "best offer" price is higher than the reserve price and any other "best offer(s)" that have been placed by any other bidder(s). If the "best offer" qualifies because it is higher than the reserve price and any other prior "best offer(s)" that have been placed by any other bidder(s), that best offer will be held waiting at Step 247 for the auction system 200 to reduce the bid price to match the input "best offer" with the currently displayed bid price at Step 240. In another exemplary embodiment, Steps 245,246,247 may be optional.

If no bid is initially received at Step 240, the system checks if the amount of time that will expire on the system clock prior to the next reduction of the bid price has occurred at Step 250. If NO, the system returns to Step 230. If YES at Step 250, then the bid price is decremented at Step 260 by the calculated or preset bid decrement amount. The predetermined period of time can either be a fixed time (i.e. reduce price every five minutes or five seconds) or at a variable time as determined by some combination of number of participants and the activity of those and/or their demonstration of intention to make a transaction (i.e. reduce price after two minutes, reduce price again after 30 seconds because several participants are engaging simultaneously, or the price drop can be delayed for the same reason, etc.). These may occur simultaneously. In another exemplary embodiment, the time check at Step 230 only checks if the auction end time is met. If there is time remaining or the currently displayed bid price is above the reserve price, the system returns back to Step 240 to wait for a bid. If either the end time or the reserve price is met, the auction is determined to be complete with no auction winner at Step 270.

In an exemplary embodiment, the auction system 200 may also implement an additional time feature to generate last minute excitement in an auction. At a predetermined price point above the reserve price, a determination is made as to the excitement level in the auction. The auction system 200 can also calculate an excitement value that is based upon the number of event participants or visitors and/or including excitement in the event vehicle demonstrated by actions of those participants. If the excitement value exceeds a predetermined metric that shows significant intent to purchase by those participants and there is an authorized additional price reduction by the seller, the auction system 200 will be extended by the amount of time needed to countdown to the new price.

Figure 3:
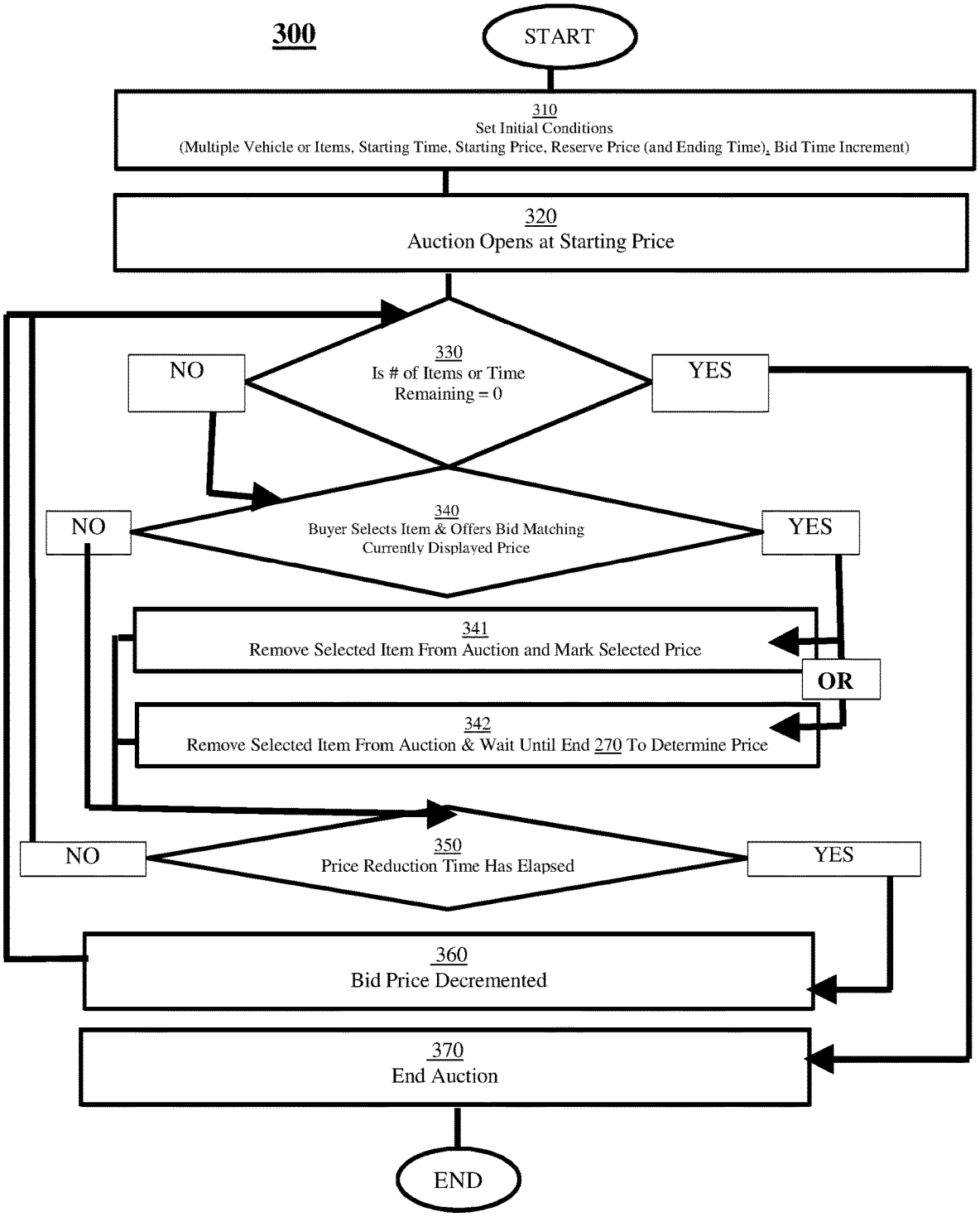
FIG. 3 shows a flow diagram of an exemplary simultaneous multiple item auction system with a Bid Price Reduction or Increasing Incentive implementation system.

FIG. 3 shows a flow diagram of an exemplary multiple item auction system 300 with a Bid Price Reduction or Increasing Incentive implementation. The multiple item auction system 300 allows for multiple items to be bid on simultaneously with a bid price continuously decreasing to reduce down to a preset reserve price. As an example, three vehicles of the same make, model and year are enrolled in a single auction. Due to certain variations of included features, packages and/or market valuation variations for certain exterior and/or interior vehicle colors, the three vehicles may have different values or different desirability to potential buyer participants. The event and the platform will enable the participants to reconcile these differences in perceived or actual value and select the one they want at the price they want subject to competition from other potential buyer participants. The event will proceed with a regularly or otherwise scheduled dropping price following the identical scenario for a single vehicle Bid Price Reduction or Increasing Incentive implementation event. There are two designed scenarios for setting the final bid price for each vehicle. In Scenario 1 represented by Step 341, a participant may select the vehicle he wants when the price falls to an acceptable number. The placing of that bid selects that vehicle and sets the price at the value of the currently displayed bid price when that vehicle is selected. That vehicle is no longer available to the other participants, but the remaining vehicles are still available to other participants and the currently displayed bid price continues to drop until the reserve is met at which time the event will end regardless of whether any number of bids have been placed. In Scenario 2 represented by Step 342, a first bidding participant can select the vehicle of choice without determining the price. Another bidder can then select one of the remaining vehicles, again without determining a price. This would continue until only one vehicle remained, and the bid on that vehicle, which would be the lowest price in the event, would determine the price for all of the vehicles, and this would also end the event. Variations on this second scenario would change the price setting bid to be made and the event ended with a bid on one of the remaining vehicles, but not the last one or set the price for all participants at the ending price or reserve or some value higher than after an acceptable number of vehicles have sold. Any number of remaining vehicles can be set as the trigger for ending the event or this may be set in real time in response to participant activities or the frequency by which bids are placed. These scenarios would serve to better preserve seller profit margins.

In another exemplary variation, this system can be used to present and sell any type of product or service where multiple units exist, even if those units are identical or nearly identical. For example, a seller can list 100 hammers starting at $20 with that price reducing by a calculated or preset amount every 60 seconds. Similarly, a seller can offer to sell 10 manicure appointments starting at $50 with that price reducing by a calculated or preset amount every 5 minutes. Either Scenario 1 or Scenario 2 can be used to establish pricing and end time as described above.

At step 310, the initial conditions for the auction system 300 is set by an administrator or are otherwise present by default. For example, the vehicles or units for auction are selected, the start and end time of the auction is set, or total auction time is otherwise set. Also, the default time to elapse before each bid decrement is set, i.e. 30 seconds or other such desired time value in this step. Also, a starting price for the auction and an ending or reserve price, which is used to determine the ending time, are set at step 310.

Once the auction begins, the auction opens at the starting price at Step 320. Next, the auction system 300 checks to determine whether the time remaining in the auction equals zero or the number of units remaining available for sale has reached zero ("0") at Step 330. If either condition equals Zero ("0"), the auction ends at Step 370. If neither condition equals zero ("0"), the system 300 checks to see if a bid equal to the currently displayed bid price is received at Step 340. If no bid is received at Step 340, the system 300 moves to Step 350 to determine whether the predetermined period of time to elapse before the next price decrement or drop has passed. The predetermined period of time can either be a fixed time (i.e. reduce price every five minutes) or at a time that is calculated to equal the time elapsed between each of the number of periods needed to reduce the start price to the reserve price when each reduction equals the preset bid decrement amount, or at a random time (i.e. reduce price after two minutes, reduce price again after four minutes, etc.), or based upon logic that reflects participant interest. If the time period has not elapsed at Step 350, the system 300 returns to Step 330. If the time period at Step 350 has elapsed, the bid price is decremented at Step 360 by the calculated or preset bid decrement.

If a selection for a specific vehicle or unit along with the bid equal to the currently displayed price is received at Step 340, the selected item is removed from the auction and the price for the item is determined by the administrator preselected choice of either Scenario 1 at Step 341 or Scenario 2 at Step 342. The auction system 300 then moves to Step 350.

Once the auction system 300 reaches End Auction at Step 370, participants are notified and advised of the pricing applicable to them based upon the administrator's preselected Scenario 1 at Step 341 or Scenario 2 at Step 342.

In another exemplary embodiment, the Bid Price Reduction or Increasing Incentive implementation systems in either single or multiple unit implementations to market any goods or services for which the method of reducing the price in front of multiple potential buyers in order to seek a purchase commitment from one or more of them would satisfy a seller's goals. Examples would be the auctioning of artwork or jewelry or the selling of regular services such as time shares, ride shares of part time use of vehicles.

Figure 4:
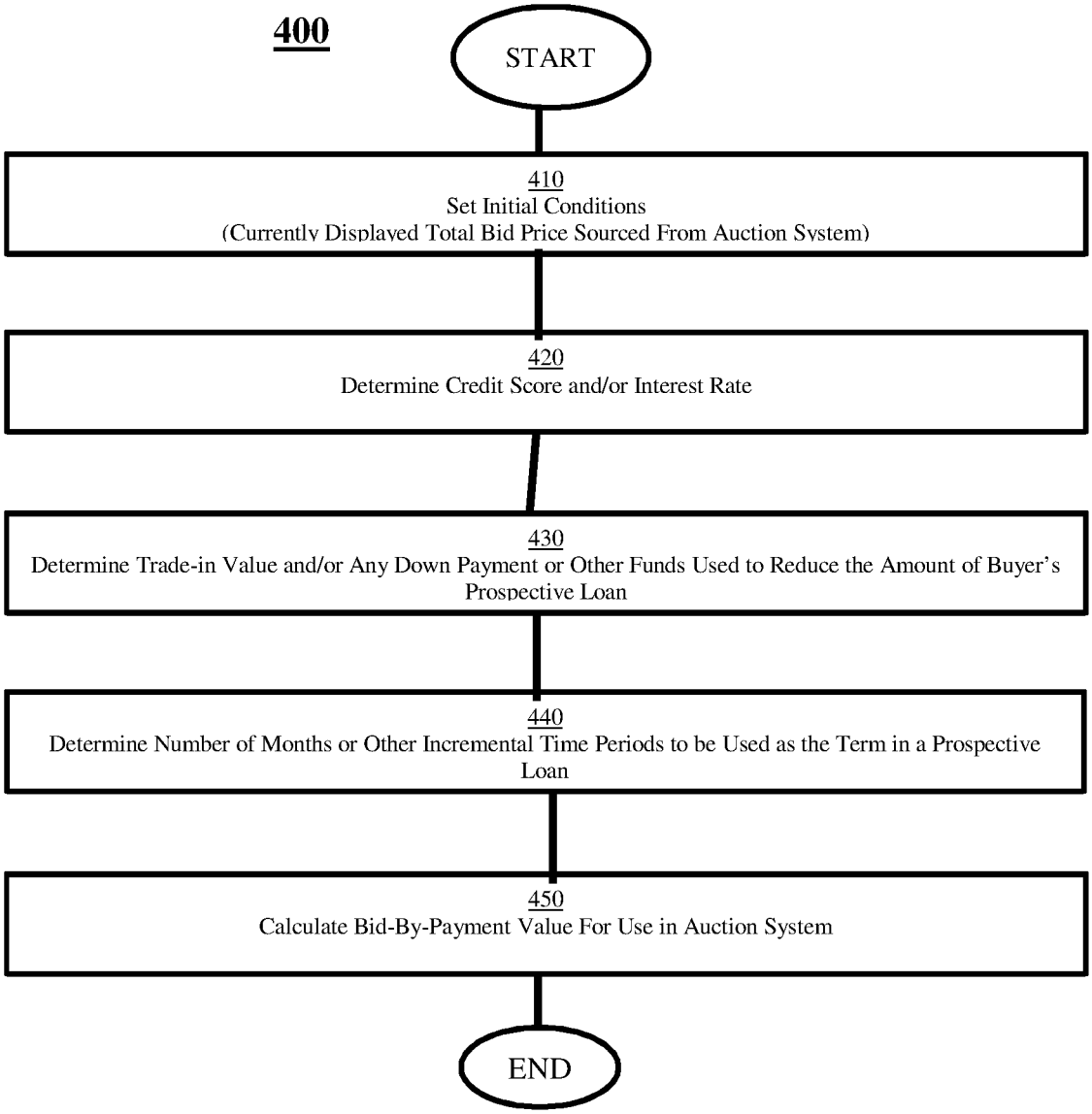
FIG. 4 shows a flow diagram for an exemplary system to determine Bid-By-Payment function for auction bidding.

FIG. 4 shows a flow diagram for an exemplary system to determine a Bid-By-Payment system 400 for auction bidding. In an exemplary embodiment, the auction systems 100, 200, 300, can be enabled to allow a bidder to bid by a monthly, or other regular time increment, payment price instead of a full payment bid. In other words, the combination(s) of a certain credit worthiness or ability to finance the final purchase, in conjunction with or without a down payment, which may be cash or any other item of value such as a trade-in vehicle, and loan payment period can be input into the auction system 100, 200, 300, to allow for a bidder to bid by monthly, or any other regular increment, payment price. The Bid-By-Payment system 400 will calculate the value of each proposed bid so that it can be compared to the other bids and/or currently displayed bid prices and/or "Best Offers". The result of these comparisons by the Bid-By-Payment system 400 will be normalized values for every bid that will allow all other auction systems with which it is enabled including auction system 100, 200, 300 to input bids in the format that that those systems use in their normal operations.

In the bid payment system 400, Step 410 determines the current total price or cost of the item being sold by the auction by sourcing this information from the auction system 100, 200, 300, or any other auction system which total can include any taxes or transactional fees or processing costs if desired by the seller. These inputs would be made when the auction is set up and the pricing information is entered. Step 420 determines the credit worthiness or credit score of a bidder or alternatively another method of determining the bidder's ability to finance the purchase in order to associate an interest rate percentage that the Bid-By-Payment system 400 can use for each Bid-By-Payment calculation. The interest rate for each value of credit score is set by the administrator. The interest rate to be used for this calculation may also be a pre-determined should the administrator wish to show the same value to all bidders, and this value may also be zero ("0"). In an exemplary embodiment, the credit score of a bidder can be estimated or the actual credit score or any similar commercially used estimated score can be pulled into the Bid-By-Payment system 400 to determine credit worthiness and return an initial interest rate and/or the system can allow the bidder to enter a credit score or range, and/or allow the bidder to select an interest rate for use in the Bid-By-Payment calculation of pricing. Next, Step 430 allows for a trade-in value and/or other down payment information to be in input to reduce the total potential financial obligation of the buyer and thereby reduce the cost of the payments. Further, Step 440 determines how many months or units of another incremental period that a bidder desires to set for a prospective loan period which may reduce or increase the final value of the payments. Once the information has been entered and/or collected, a Bid-By-Payment is calculated at Step 450. The platform can also be set with a default of showing Bid-By-Payment based upon a predetermined pricing calculation (credit worthiness/interest rate, trade-in value or other down payment amount and loan term in months or other increment) and/or show each individual participant a customized formula that yields an individualized Bid-By-Payment value based upon data about that participant which is available to the platform.

In an exemplary embodiment, the Bid-By-Payment is preset prior to an auction so the variables match a fixed pre-determined offer and the only value that changes is the value of the monthly payment price (or other time increment price) based on the total value of the current auction bid price.

In another exemplary embodiment, the bid by payment value may be altered by changing the number of months or other increment for the loan period which may reduce or increase the value of the payment based on how many months or other incremental periods the loan term will be.

In another exemplary embodiment, the Bid-By-Payment system can be configured to work with actual financing platforms to incorporate a true offer of financing with the Bid-By-Payment enabled auction system.

In another exemplary embodiment, the Bid-By-Payment system can be configured to work with any pre-existing auction system in commercial use and enable bidder participants of those systems to view and, if desired, place potential bids as a combination of multiple payments for a loaned amount used to make the purchase of the item purchased at the auction.

In another exemplary embodiment, the Bid-By-Payment system can be configured to work with any auction style system to enable the purchase and sale of any product or service that might be financed or may be purchased by making regular recurring payments. Examples would be the auctioning of artwork or jewelry or the selling of any products or services such as time shares, ride shares of part time use of vehicles.

Other example embodiments include various methods for running auctions. A method for auctioning vehicle or any other product or service online includes providing, via a processor, initial auction conditions, the initial auction conditions comprising an auction start and a finish time, a minimum bid or a starting price, a reserve price and a bid increment, receiving one or more bids, evaluating the one or more bids against the initial auction conditions and each other to yield an evaluation and determining, based on the evaluation, an outcome of the auction, the outcome comprising identifying a winner when that participant's bid meets the initial action conditions for a winning bid, and identifying any other non-winning participants.

Another method for auctioning or determining an agreeable price between a seller and a buyer and for a completion of a transaction for a vehicle or any other product or service online includes receiving one or more bids and providing, via a processor, initial conditions featuring a starting price point that is higher than a minimum acceptable price that the seller will accept and a protocol by which to reduce the agreeable price over time until a bid is offered by the buyer or until the minimum acceptable price that the seller will accept is reached.

A same protocol can be used for determining an agreeable price or prices between the seller and multiple buyers for more than one unit of a similar product or service. In another aspect, the one or more bids is equal to a total price of a required bid shown in an auction.

The one or more bids can be presented as multiple payments to be made monthly or in another increment of time, a total value of which are the same, as a total price of a required bid shown in the auction. A total cost of the payments may or may not also include finance charges and/or transactional costs and/or fees. The one or more bids can be equal to a total price of a required bid shown in the auction.

The one or more bids can be presented as multiple payments to be made monthly or in another increment of time, a total value of which are the same, as a total price of a required bid shown in an auction, and where a total cost of the payments may or may not also include finance charges and/or transactional costs and/or fees.

This disclosure is intended to explain how an auction system is constructed and used or can be used according to various embodiments in accordance with the technology rather than to limit the true, intended, and fair scope thereof. The foregoing description is not intended to be exhaustive or limited to the precise forms disclosed. Modifications or variations are possible in light of the above teachings and disclosure. Feature from any example or embodiment can be combined with any other example or embodiment. Any group of operations or steps can be programmed into a computer module that is operable on a computing device to perform the specific series of steps, which results in a special purpose computer. The method can be practiced with the steps occurring in any order even if different from what is described above. The embodiments were chosen and described to provide an illustration of the principles of the described technology and its practical application, and to enable one of ordinary skill in the art to utilize the technology in various embodiments and various modifications as are suited to the particular use contemplated.

I claim:

1. A method for auctioning or determining an agreeable price between a seller and a buyer and for a completion of a transaction for a vehicle or any other product or service online, the method comprising:

receiving one or more bids; and providing, via a processor, initial conditions featuring a starting price point that is higher than a minimum acceptable price that the seller will accept and a protocol by which to reduce the agreeable price over time until a bid is offered by the buyer or until the minimum acceptable price that the seller will accept is reached;

wherein the initial conditions include a starting auction time, an ending auction time, and a plurality of price reduction time periods to sequentially occur within an auction time interval extending from the starting auction time to the ending auction time, wherein a duration of the price reduction time periods is a preset initial condition;

determining a number of the price reduction time periods occurring between starting auction time and the ending auction time, determining a difference between the starting price point than the minimum acceptable price, and dividing the determined number of the price reduction time periods by the determined difference to thereby generate a bid decrement amount;

wherein the protocol comprises, at expiration of each price reduction time period, if no bid was received during that price reduction time period, reducing the agreeable price by the bid decrement amount.

2. The method of claim 1, wherein a same protocol can be used for determining an agreeable price or prices between the seller and multiple buyers for more than one unit of a similar product or service.

3. The method of claim 1, wherein the one or more bids is equal to a total price of a required bid shown in an auction.

4. The method of claim 1, wherein the one or more bids are presented as multiple payments to be made monthly or in another increment of time, a total value of which are the same, as a total price of a required bid shown in the auction, and where a total cost of the payments may or may not also include finance charges and/or transactional costs and/or fees.

5. A system for auctioning or determining an agreeable price between a seller and a buyer and for a completion of a transaction for a vehicle or any other product or service online, the system comprising:

a processor; and a non-transitory computer-readable storage medium storing instructions which, when executed by the processor, cause the processor to perform operations comprising:

receiving one or more bids; and providing, via a processor, initial conditions featuring a starting price point that is higher than a minimum acceptable price that the seller will accept and a protocol by which to reduce the agreeable price over time until a bid is offered by the buyer or until the minimum acceptable price that the seller will accept is reached;

wherein the initial conditions include a bid decrement amount that is fixed, a starting auction time, and a plurality of price reduction time periods sequentially occurring within an auction time interval extending from the starting auction time to an ending auction time, the price reduction time periods each representing a same fixed amount of time;

calculating a number representing how many of the bid decrement amounts are to be subtracted from the starting price point until the agreeable price becomes equal to the minimum acceptable price, and determining an ending auction time by multiplying the calculated number by the fixed amount of time and adding a result of the multiplication to the starting auction time;

wherein the protocol comprises, at expiration of each of the number of the price reduction time periods if no bid was received during that price reduction time period, reducing the agreeable price by the bid decrement amount.

6. The system of claim 5, wherein a same protocol can be used for determining an agreeable price or prices between the seller and multiple buyers for more than one unit of a similar product or service.

7. The system of claim 5, wherein the one or more bids is equal to a total price of a required bid shown in an auction.

8. The system of claim 5, wherein the one or more bids are presented as multiple payments to be made monthly or in another increment of time, a total value of which are the same, as a total price of a required bid shown in the auction, and where a total cost of the payments may or may not also include finance charges and/or transactional costs and/or fees.

* * * * *